US010834975B2

(12) United States Patent
Heisser

(10) Patent No.: US 10,834,975 B2
(45) Date of Patent: Nov. 17, 2020

(54) UNDERGARMENT THAT RESISTS BUNCHING

(71) Applicant: Ronald Henry Heisser, San Antonio, TX (US)

(72) Inventor: Ronald Henry Heisser, San Antonio, TX (US)

( * ) Notice: Subject to any disclaimer, the term of this patent is extended or adjusted under 35 U.S.C. 154(b) by 215 days.

(21) Appl. No.: 15/973,473

(22) Filed: May 7, 2018

(65) Prior Publication Data

US 2018/0317567 A1 Nov. 8, 2018

Related U.S. Application Data

(60) Provisional application No. 62/503,040, filed on May 8, 2017.

(51) Int. Cl.

| | |
|---|---|
| ***A41B 17/00*** | (2006.01) |
| ***A41B 9/02*** | (2006.01) |
| ***A41B 9/00*** | (2006.01) |
| ***A41F 17/00*** | (2006.01) |

(52) U.S. Cl.

CPC ..... *A41B 17/00* (2013.01); *A41B 9/001* (2013.01); *A41B 9/02* (2013.01); *A41F 17/00* (2013.01); *A41B 2300/20* (2013.01); *A41B 2400/44* (2013.01)

(58) Field of Classification Search

CPC ..... A41F 17/00; A41B 17/00; A41B 2300/20; A41B 2300/35; A41B 2300/52; A41B 9/001; A41B 9/02; A41B 9/04; A41B 9/08; A41B 9/12

See application file for complete search history.

(56) References Cited

U.S. PATENT DOCUMENTS

| | | | | |
|---|---|---|---|---|
| 2,310,103 | A * | 2/1943 | McDonald | A41B 9/06 2/113 |
| 3,228,401 | A * | 1/1966 | Byrne | A41B 17/00 450/114 |
| 3,559,654 | A * | 2/1971 | Pope, Jr. | A41B 11/12 450/95 |
| 5,745,917 | A * | 5/1998 | Dicker | A41D 13/0015 2/115 |
| 7,631,367 | B2 * | 12/2009 | Caillibotte | A41D 13/0015 2/228 |
| 2009/0025124 | A1 * | 1/2009 | Gearhart | A41F 17/00 2/406 |
| 2016/0000152 | A1 * | 1/2016 | Martin | A41B 9/06 2/113 |
| 2018/0177245 | A1 * | 6/2018 | Glaude | A41F 9/025 |

* cited by examiner

*Primary Examiner* — Kristen Matter
(74) *Attorney, Agent, or Firm* — Larisa Migachyov

(57) ABSTRACT

An undergarment comprising at least one tubular portion, wherein the tubular portion is reinforced with stiffeners in the direction parallel to the axis of the tube, to prevent bunching when another garment is put on over the undergarment.

21 Claims, 10 Drawing Sheets

UNDERGARMENT THAT RESISTS BUNCHING

CROSS-REFERENCE TO RELATED APPLICATION

The present application takes priority from Provisional App. No. 62/503,040, filed May 8, 2017, which is herein incorporated by reference.

BACKGROUND

Field of the Invention

The present invention pertains generally to garments, and more particularly to undergarments that resist bunching when another garment is put on over the undergarment.

Background

Most people who wear undergarments are familiar with a problem that arises when another garment is put on over an undergarment that is moderately loose, such as boxer shorts or an undershirt. In this situation, the undergarment tends to bunch up due to frictional forces between the fabric of the undergarment and the fabric of the other garment and the curvature of some body parts. The bunching happens in the horizontal direction and results in bulky crumpled fabric under the other garment, which is uncomfortable and unsightly. The wearer then has to perform various contortions to get the undergarment straightened out.

While a tighter undergarment would solve the problem, it introduces other problems. For example, very tight boxer shorts or undershirts are uncomfortable for many wearers. Furthermore, some wearers may dislike the aesthetics of very tight underwear or undershirts.

A need exists for undergarments that fit loosely and are flexible enough to be comfortable while also resisting bunching when another garment is put on over the undergarment or when the garment rubs against the undergarment during normal movement of the limbs.

LIST OF FIGURES

SUMMARY OF THE INVENTION

Figure 1A:
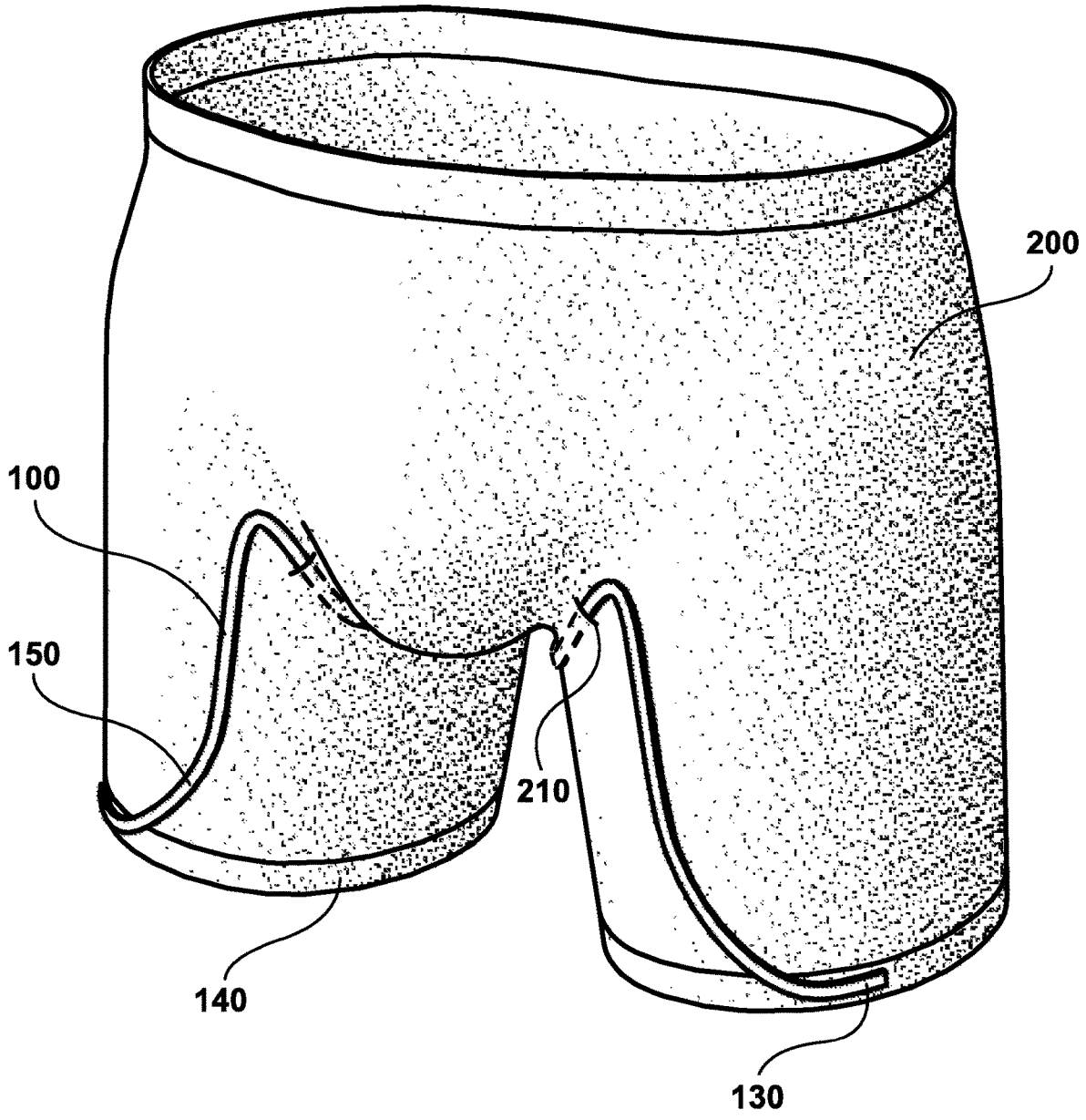
FIG. 1A shows a front view of the preferred embodiment of the present invention as applied to undershorts.
Figure 1B:
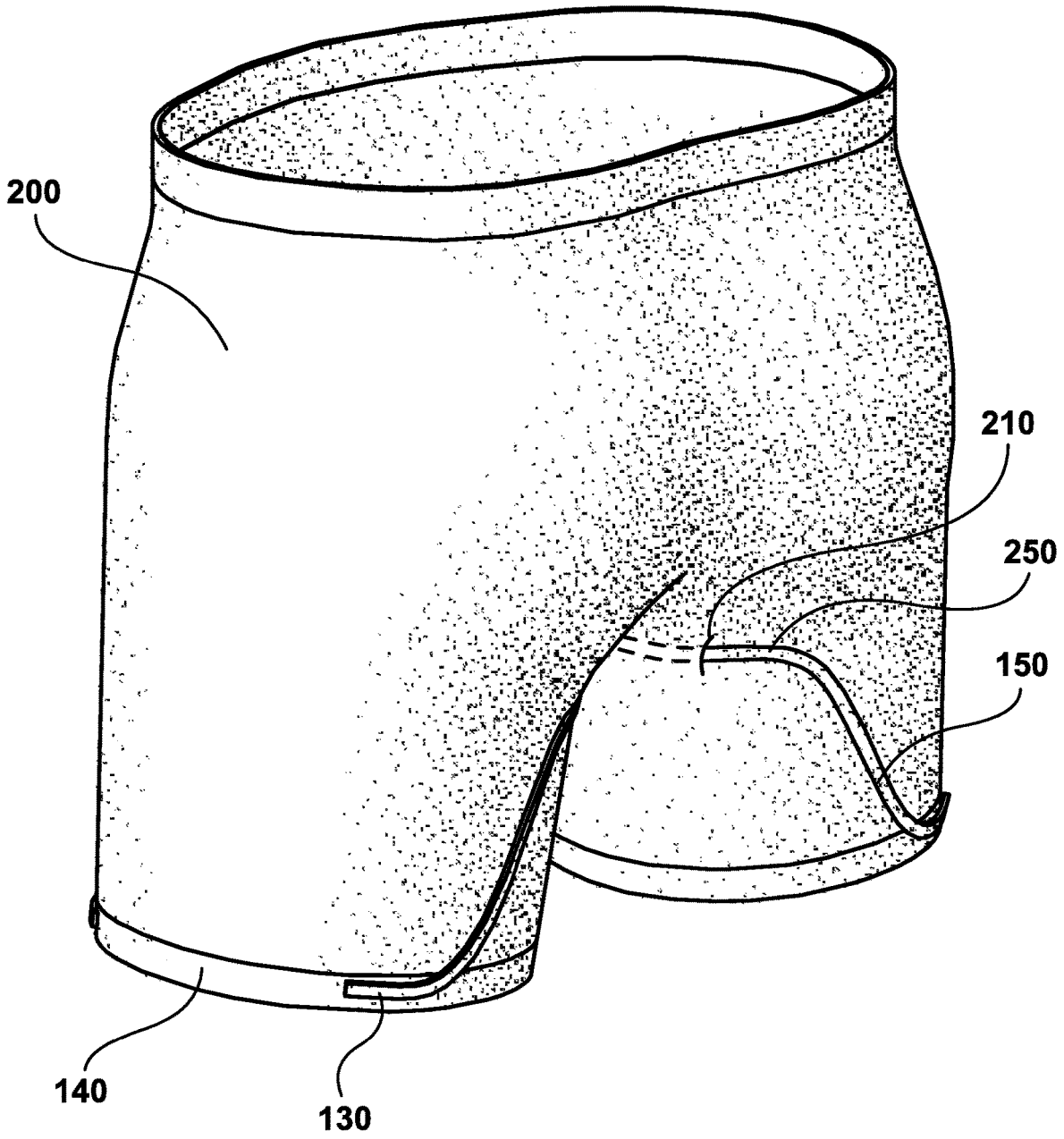
FIG. 1B shows a rear view of the preferred embodiment of the present invention as applied to undershorts.
Figure 2A:
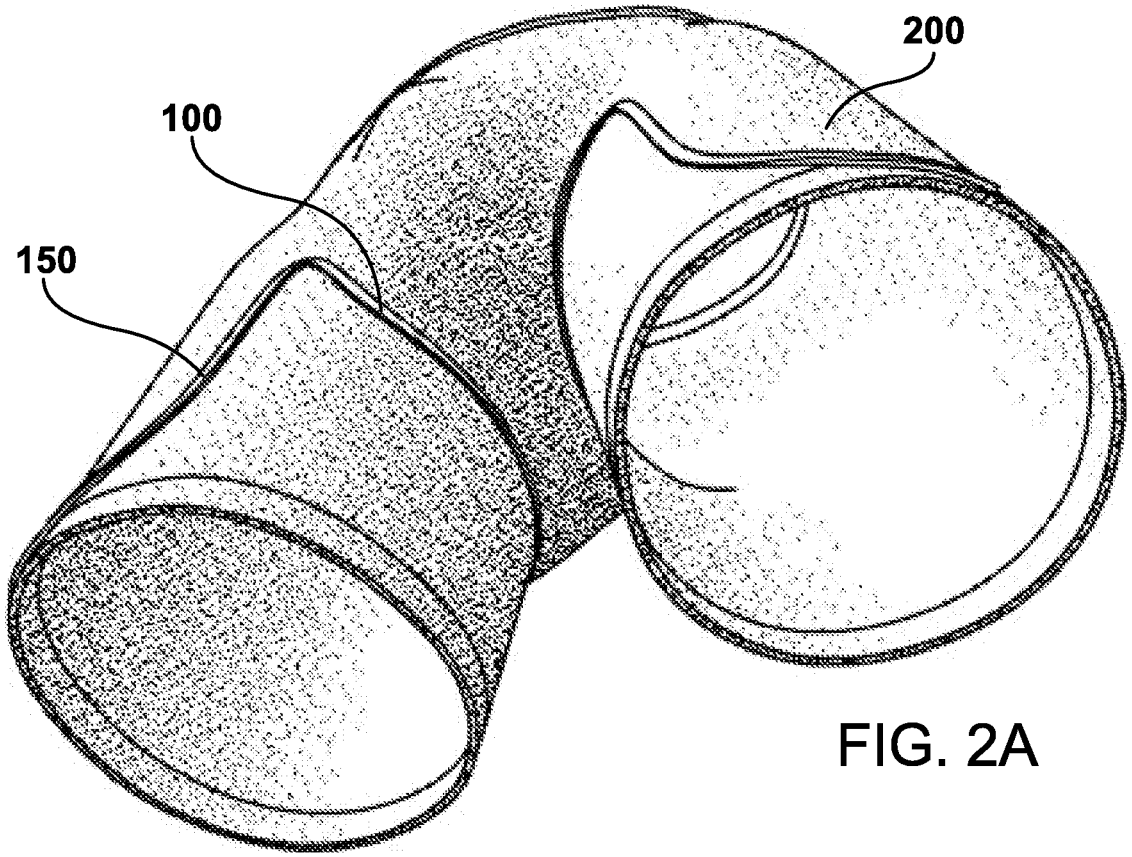
FIG. 2A shows a bottom front view of the preferred embodiment of the present invention as applied to undershorts.
Figure 2B:
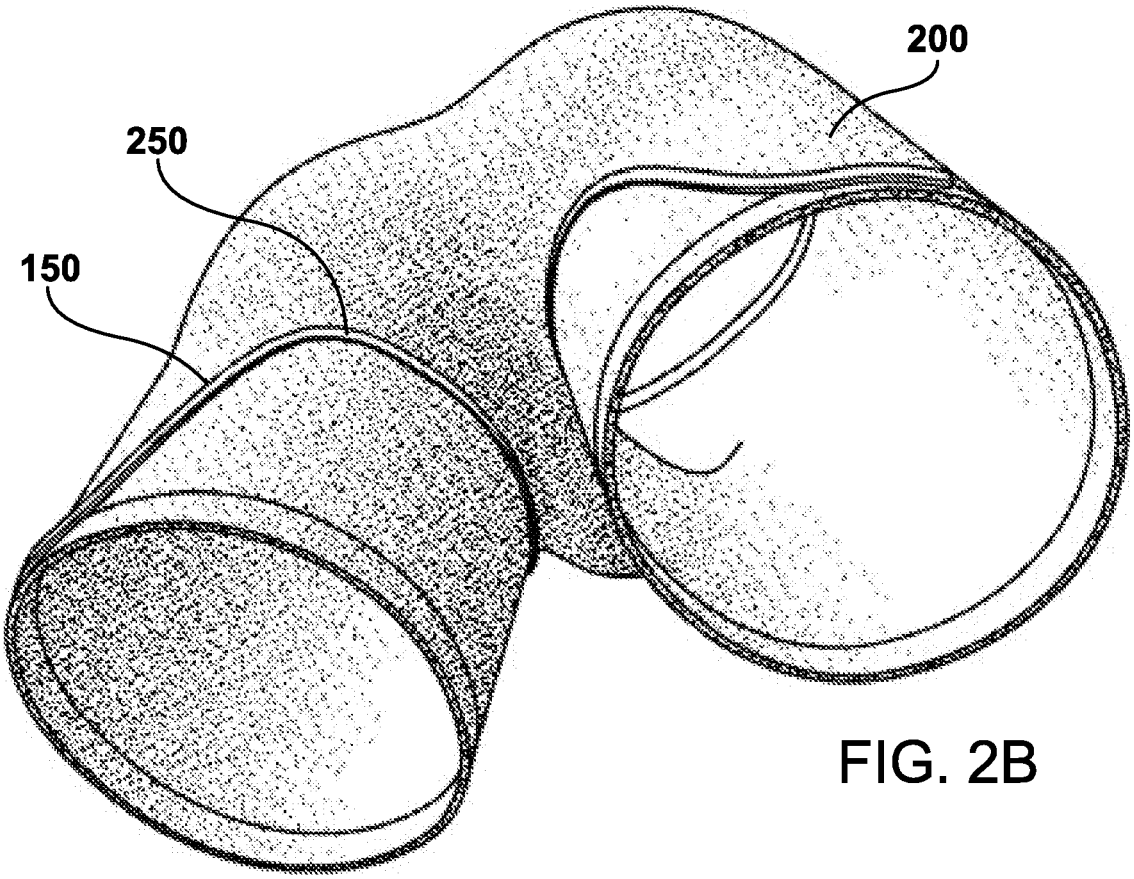
FIG. 2B shows a bottom rear view of the preferred embodiment of the present invention as applied to undershorts.

An object of the present invention is to prevent horizontal bunching in an undergarment that comprises a generally tubular shape.

The present invention comprises a garment that is intended to be worn under another garment, which comprises at least one fabric tube. At least one stiffener is permanently attached to the tube in a vertical direction to prevent the tube from bunching in that direction when a frictional force is applied to the garment.

The stiffener may be attached to the tube in a vertical direction, a spiral direction, or any other direction that prevents the tube from bunching in a vertical direction. In an embodiment, both ends of the stiffener are attached to one end of the fabric tube while the middle of the stiffener is attached to the other end. In an embodiment, the stiffener is shaped like a ring and attached to the fabric tube.

The stiffener preferably comprises a polymer material and is preferably made of polyethylene.

In the preferred embodiment, the stiffener comprises a thickness, wherein the thickness is measured from a surface of the fabric tube in the direction perpendicular to the surface of the fabric tube, wherein the thickness is 0.4-2.75 mm.

In the preferred embodiment, the stiffener has a circular cross-section.

The stiffener may be a sheet element, which may comprise a stiffened fabric.

The stiffener is preferably permanently attached to the fabric tube throughout its length. In an embodiment, the stiffener may be attached to the fabric tube in at least one location along its length and not attached to the fabric tube in at least one other location.

If the stiffener is a sheet element, it may be incorporated into the fabric tube construction.

In an embodiment, the garment also comprises at least one fabric tab that is attached over an end of a stiffener.

The garment may be a pair of undershorts comprising a first leg and a second leg, wherein each leg is a fabric tube comprising at least one stiffener.

In an embodiment, the undershorts further comprise a waistband, and the at least one stiffener is connected to the waistband.

In an embodiment, the undershorts further comprise at least one leg band, and the at least one stiffener is connected to the leg band.

In the preferred embodiment, the undershorts comprise a crotch portion, and at least one stiffener comprises a vertical portion running up the length of the leg, a middle portion that is connected to the boundary between the crotch portion and the leg and is shaped in such a way as to duplicate the shape of that boundary, a second vertical portion running up the length of the leg, and two ends connected to the end of the leg.

In an embodiment, the at least one stiffener comprises a first end connected to the waistband, a second end connected to the waistband, and a middle portion connected to the end of the leg.

In an embodiment, at least one stiffener located on the inside leg portion does not extend into the crotch portion.

DETAILED DESCRIPTION

The present invention will be discussed herein below in an embodiment that particularly pertains to undergarments, specifically boxer shorts or other shorts-like undergarments. It will be understood, however, that any garment that comprises a generally tubular shape at any point in the garment, wherein the garment is worn under another garment and is vulnerable to bunching, may be used with the present invention.

For purposes of the present disclosure, "bunching" will be defined as the phenomenon of crumpling or creasing of a garment that comprises a tubular shape, when another garment is put on over the garment, due to friction between the cloth of the garment and the cloth of the other garment. Bunching is undesirable because it produces uncomfortable bulk around a tubular body part under another item of clothing, and because it requires special effort to straighten out the undergarment.

The present invention solves the bunching problem by providing stiffeners to the fabric that specifically stiffen the fabric in the direction in which bunching is most likely to occur—namely, the fabric becomes more rigid in the direction parallel to the axis of the tubular shape. For that purpose, flexible stiffeners are attached to the fabric tube, or embedded in the fabric of the fabric tube, in a direction parallel to the axis of the tubular shape. The stiffeners are preferably only stiff enough to prevent bunching, since flexibility is required for comfort.

FIGS. 1A-1B and 2A-2B show the preferred embodiment of the present invention, comprising a pair of boxer shorts. Stiffeners 100 are attached to the fabric of the shorts 200 as shown, running up the length of each leg in a vertical portion 150, through the crease between the leg and the crotch in a horizontal portion 250, and down the length of each leg in a second vertical portion 150. The ends 130 of the stiffeners 100 are attached to a leg band 140 of the boxer shorts. In the preferred embodiment, the ends 130 are secured in a way that resists detachment—for example, they may be fused with the leg band. The horizontal portion 250 is preferably shaped in a way that matches the geometry of the crease between a human thigh and crotch, to improve comfort in the wearer.

The stiffeners may be attached to the outside of the fabric tube (i.e. the side opposite the skin), the inside of the fabric tube, or may be attached to the outside in some parts of the fabric tube and inside in other parts. In the preferred embodiment, as shown, the stiffeners 100 are on the outside of the garment in the vertical portions 150, and then pass through an opening 210 to be on the inside of the garment for the horizontal portion 250. This helps secure the stiffener to the garment and prevent displacement or detachment of the stiffener in the groin area, where comfort is crucial.

The stiffeners 100 are preferably thin strips of a polymer material that are flexible enough to prevent discomfort, while being stiff enough to resist creasing or crumpling, thus preventing bunching. The elasticity of the materials used for the stiffeners can range between 0.1-100 GPa (at room-temperature in normal use conditions of the garment). In the preferred embodiment, the stiffeners are made of a thermoplastic such as polyethylene.

The stiffeners may have many different cross-sectional geometries, some of which are illustrated in FIGS. 3A-3I. It will be understood that the geometries depicted in FIGS. 3A-3I are not meant to be limiting, and that many other types of geometries are possible, as long as they are easy to manufacture, easy to attach to the fabric, and comfortable for the application. In the preferred embodiment, the stiffeners have a round cross-sectional shape as in FIG. 3A and are approximately 0.4-2.75 mm thick (wherein the thickness is the cross-sectional dimension normal to the surface of the garment). It will, however, be understood that the stiffeners may also be made of metal or composite materials, or other polymers materials, and may be produced by traditional and contemporary metal, composite, and polymer manufacturing methods, such as casting, extrusion, rolling, forming, injection molding, blow molding, rotational molding, stamping, lithography, digital stitching, laser sintering, laser cutting, ultrasonic machining, abrasive jet machining, electro- and electrochemical methods, among others. Post-processing operations may involve additional thermoforming, bending, stamping, heat treating, coating, polishing, and covering with rubber or thermoplastic sheaths as is necessary for the particular application.

Figure 3A:
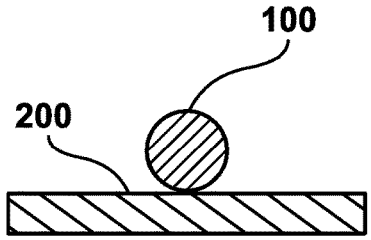
FIG. 3A shows a cross-section view of an embodiment of a stiffener.
Figure 3B:
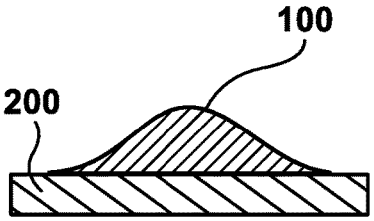
FIG. 3B shows a cross-section view of an embodiment of a stiffener.
Figure 3C:
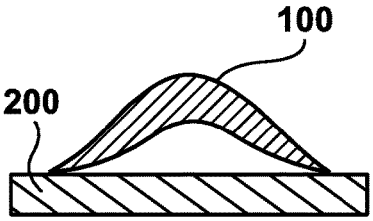
FIG. 3C shows a cross-section view of an embodiment of a stiffener.
Figure 3D:
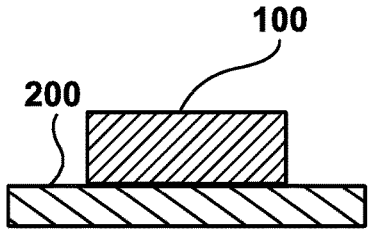
FIG. 3D shows a cross-section view of an embodiment of a stiffener.
Figure 3E:
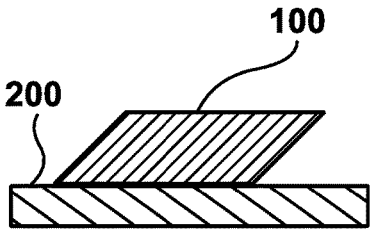
FIG. 3E shows a cross-section view of an embodiment of a stiffener.
Figure 3F:
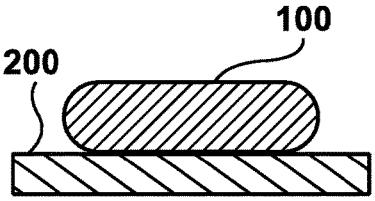
FIG. 3F shows a cross-section view of an embodiment of a stiffener.
Figure 3G:
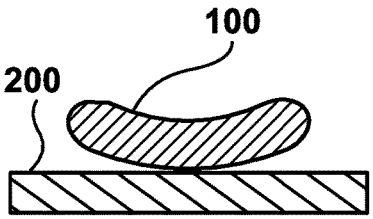
FIG. 3G shows a cross-section view of an embodiment of a stiffener.
Figure 3H:
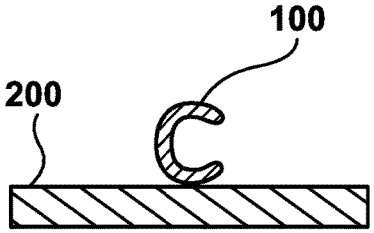
FIG. 3H shows a cross-section view of an embodiment of a stiffener.
Figure 3I:
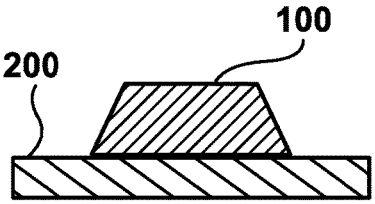
FIG. 3I shows a cross-section view of an embodiment of a stiffener.
Figure 4A:
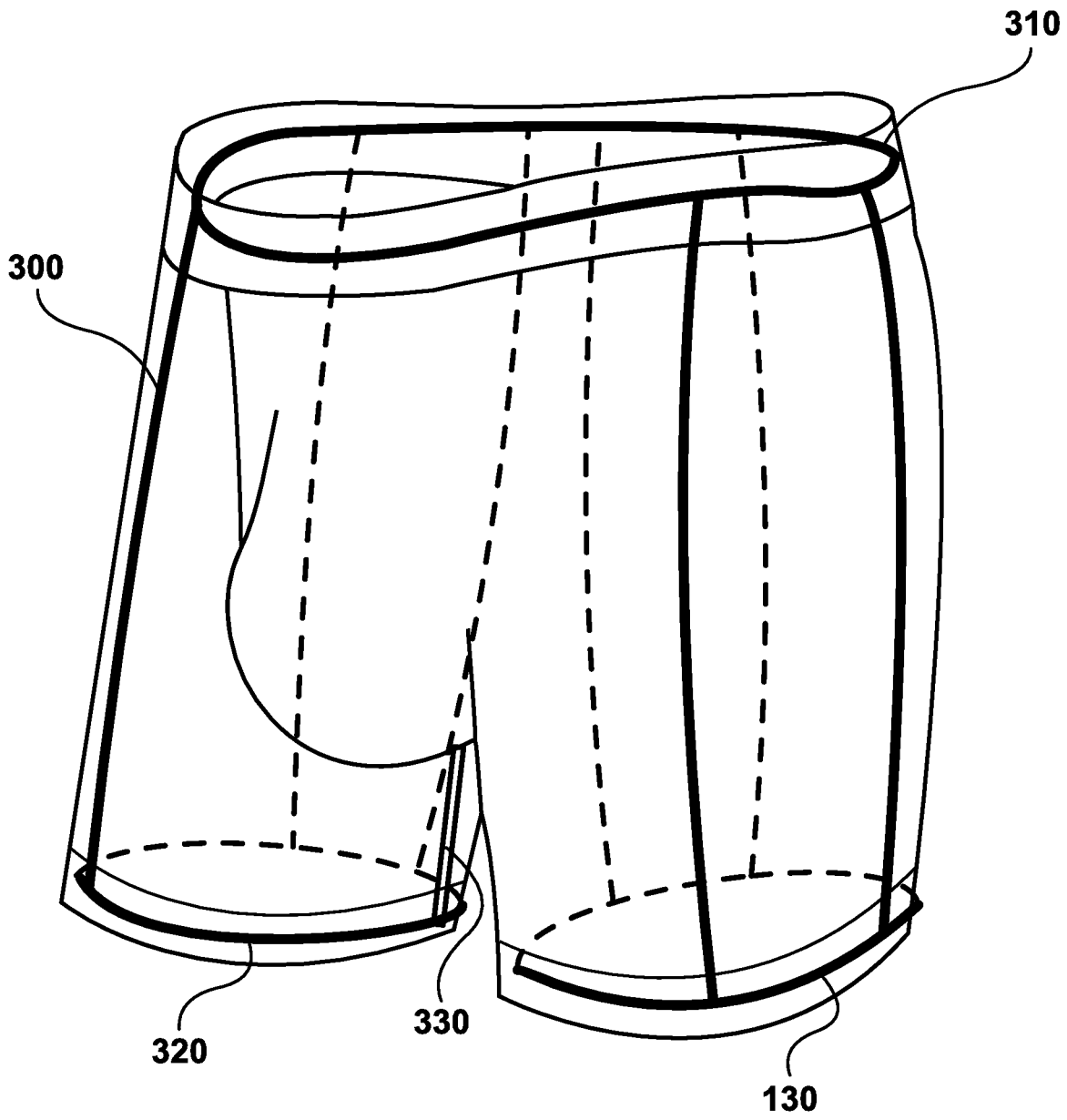
FIG. 4A shows an alternate embodiment of the present invention as applied to undershorts.
Figure 4B:
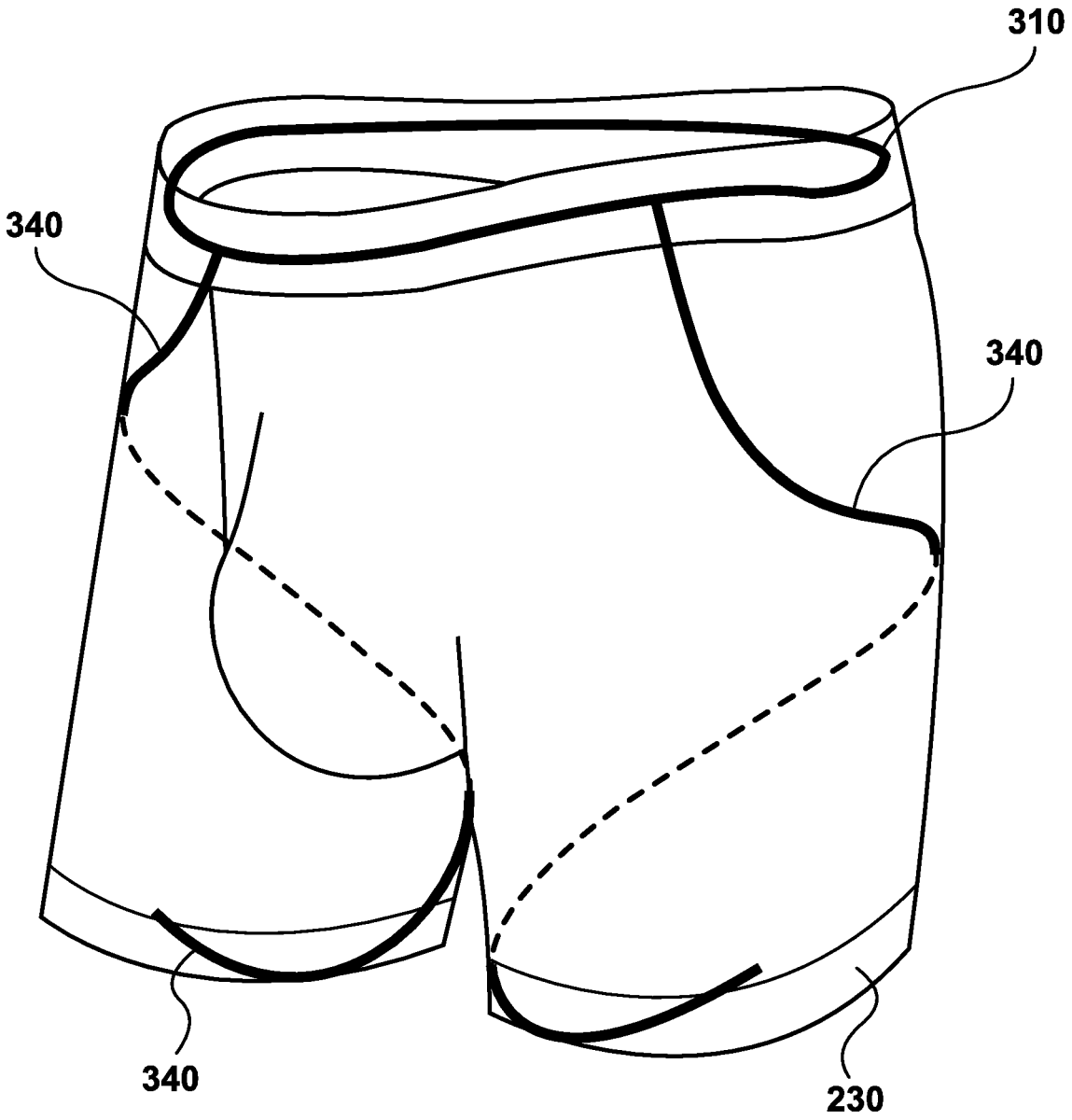
FIG. 4B shows an alternate embodiment of the present invention as applied to undershorts.
Figure 4C:
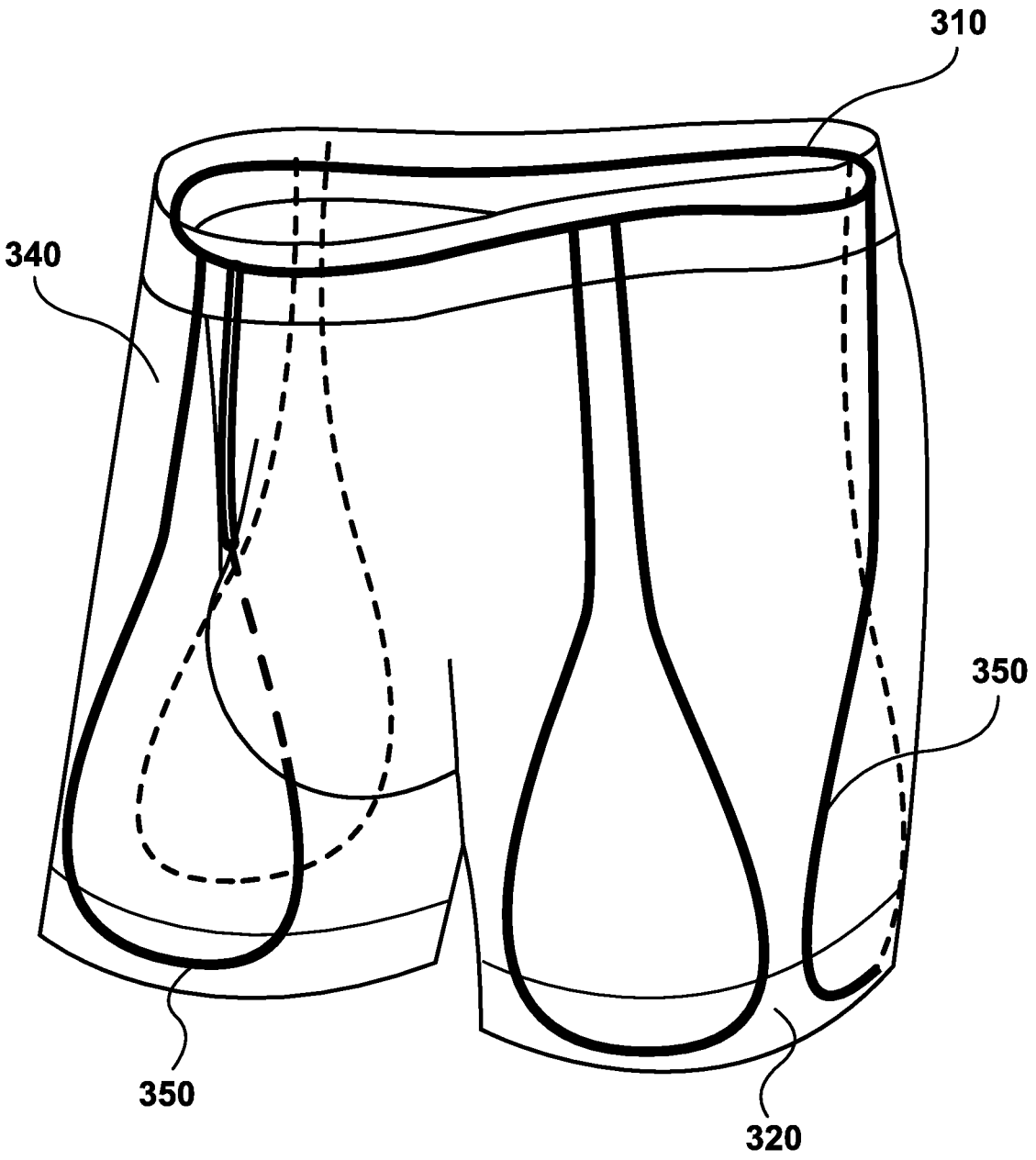
FIG. 4C shows an alternate embodiment of the present invention as applied to undershorts.
Figure 5A:
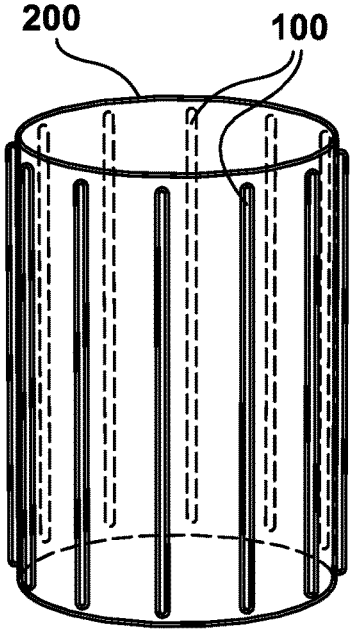
FIG. 5A shows a view of an embodiment of a stiffener arrangement on a fabric tube.
Figure 5B:
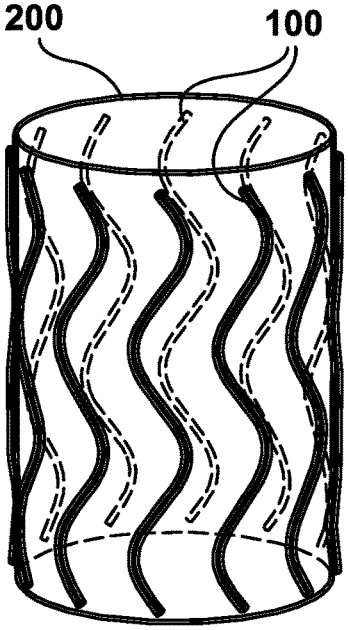
FIG. 5B shows a view of an embodiment of a stiffener arrangement on a fabric tube.
Figure 5C:
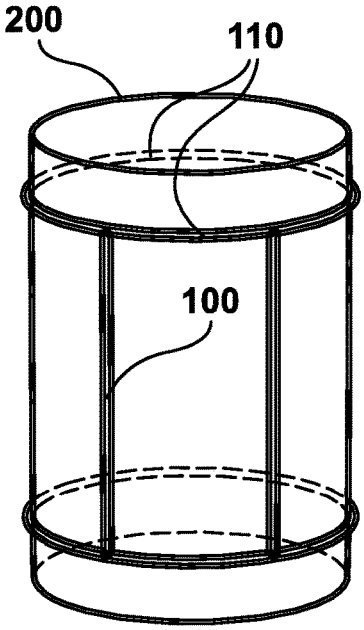
FIG. 5C shows a view of an embodiment of a stiffener arrangement on a fabric tube.
Figure 5D:
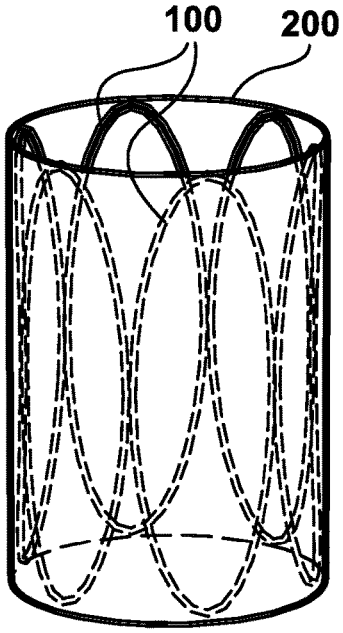
FIG. 5D shows a view of an embodiment of a stiffener arrangement on a fabric tube.
Figure 5E:
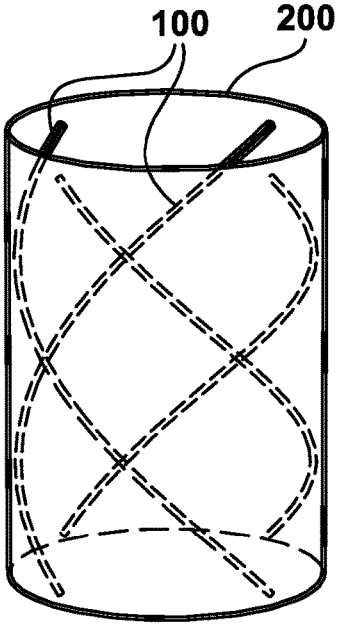
FIG. 5E shows a view of an embodiment of a stiffener arrangement on a fabric tube.
Figure 5F:
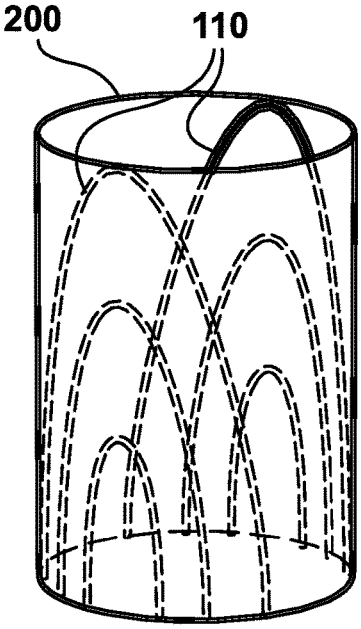
FIG. 5F shows a view of an embodiment of a stiffener arrangement on a fabric tube.

While the preferred embodiment of the present invention, as pertaining to boxer shorts, is illustrated in FIGS. 1A-2B, other stiffener arrangements are also possible for this garment and also included in the present invention. FIGS. 3A-3C illustrate two such arrangements. In FIG. 3A, stiffeners 300 are attached to the fabric of the shorts as shown, running down the length of each leg of the shorts. The ends of the stiffeners are attached to the waistband 310 and the leg bands 320. Partial stiffener 330 is attached to the inner thigh and runs only part way up the leg of the boxer shorts as shown, ending before the crotch area, to prevent discomfort.

Another embodiment of the present invention is shown in FIG. 3B, comprising spiral stiffeners 340. One end of each spiral stiffener 340 is attached to the waistband 310, while the other end is attached to the leg band 320. The spiral stiffener may wind around the leg several times, as long as the stiffness of the stiffener is such as to enable the garment to resist bunching.

Another embodiment of the present invention is shown in FIG. 3C, comprising loop stiffeners 350. In this embodiment, both ends of each stiffener are attached to the waistband 310, while the middle of the loop is attached to the leg band 320. Any number of loops may be used with this embodiment of the present invention.

Many other patterns of stiffeners may be used for embodiments of the present invention, as long as they provide adequate support to the fabric tube to resist bunching. FIGS. 5A-5F show several variations of these patterns of stiffeners 100 used to reinforce a fabric tube 200, with the understanding that these patterns are not meant to be limiting.

The stiffeners may be attached to the garment body before or after the fabric parts are joined. If attached before the fabric parts are joined, the stiffening element may be inserted or sewn or bonded or interlaced or extruded or thermoset or injected into the garment body fabric. The stiffeners may also be incorporated after the garment body has been completely produced. In an embodiment, the stiffener is produced by repeatedly adding more and more sewn stitches to a part of a garment until the part of the garment becomes stiff enough to resist bunching. Garments may include additional features which may be inserted or sewn or bonded or interlaced etc. with the garment body to provide a superior interface for the attachment of the garment body to the stiffening element and allow for proper motion with the body. Additional geometries may be included in the fabric itself to serve as a guide for the stiffening element as it is incorporated into the fabric. Additional flanges or tabs included in the garment design may be wrapped and bonded or sewn or heat-sealed around a particular part of a stiffening element.

These assembly processes may also include design of equipment which can produce a customizable geometry, involving one or more of the above-mentioned assembly/joining techniques involved with this technology. In an embodiment, measurements for this customization may be conducted using 3D laser scanning methods.

In some embodiments, the entire length of the stiffener is attached to the fabric; in other embodiments, only the ends of each stiffener are attached to the fabric, while the intervening portion is not attached. In other embodiments, the stiffener may be attached to the fabric in some areas while not attached in others.

There is a possibility that additional fabric support is needed for the stiffening element to stay in place. In one embodiment of the present invention, a fabric tab is used to secure an end of the stiffening element. This additional point of contact also helps to lessen any attachment forces the garment body may experience from the stiffening element during use, which may decrease the life of the garment. Furthermore, a fabric tab over the end of the stiffener helps prevent poking and improve comfort. The fabric tab is preferably only large enough to contain the end of the stiffener. In another embodiment, as shown in FIGS. 3A-3C, the stiffeners may be fused to a waistband and/or leg bands to keep them in place.

It should be noted that figures depicting this technology do not imply which orientation is right-side up. Other orientations may be applicable and even necessary for proper implementation of the technology.

Figure 6A:
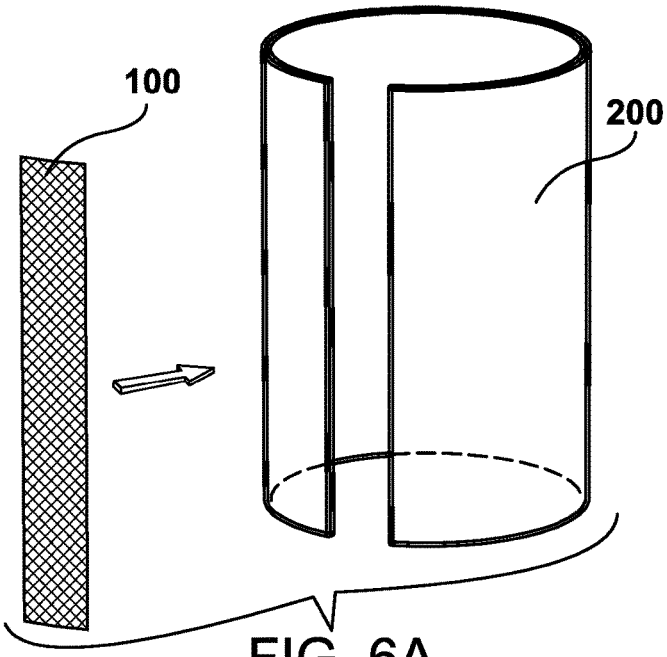
FIG. 6A shows an alternate embodiment of a stiffener as applied to a fabric tube.
Figure 6B:
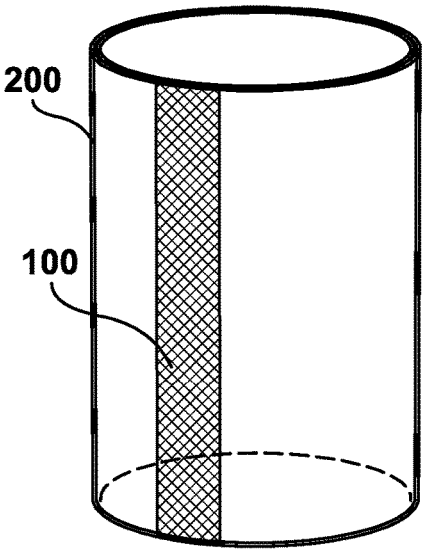
FIG. 6B shows an alternate embodiment of a stiffener as applied to a fabric tube.
Figure 6C:
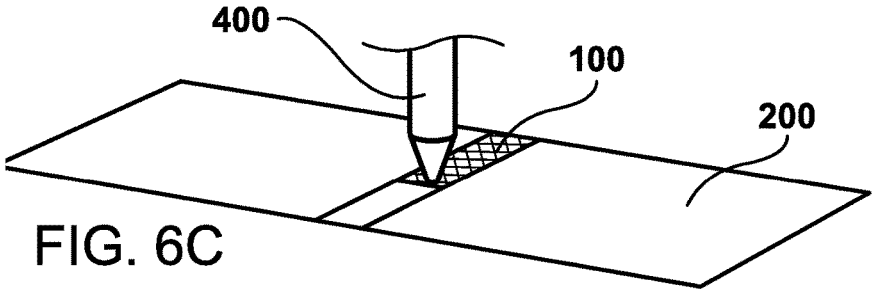
FIG. 6C shows an alternate embodiment of a stiffener as applied to a fabric tube.
Figure 6D:
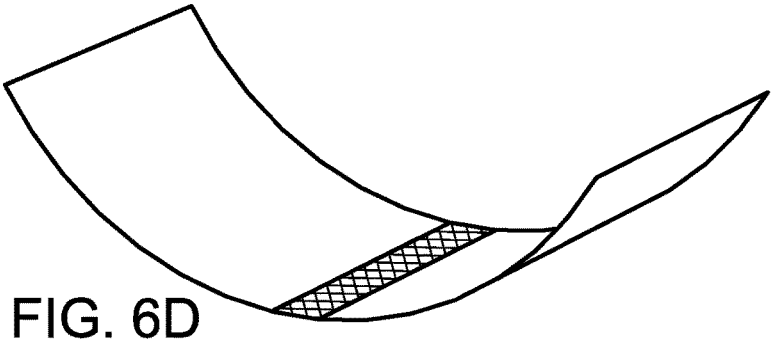
FIG. 6D shows an alternate embodiment of a stiffener as applied to a fabric tube.
Figure 6E:
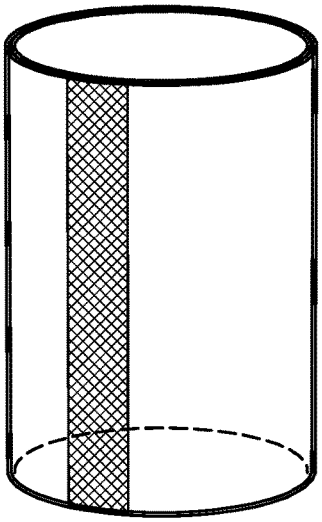
FIG. 6E shows an alternate embodiment of a stiffener as applied to a fabric tube.

In an embodiment, the additional stiffness is provided by directly incorporating stiffening elements into the garment body, as shown in FIGS. 6A-6E. In this embodiment, the garment experiences additional resistance to falling or bunching with simple incorporation of stiffening elements into the garment body. As shown in FIG. 6A, a piece of stiffened fabric may be incorporated into the fabric tube. Alternately, the fabric tube itself may be stiffened, as shown in FIG. 6C. For example, the fabric may be stiffened by embroidery, embedding an extra substance in the fabric, laminating the fabric, and so on.

Figure 7:
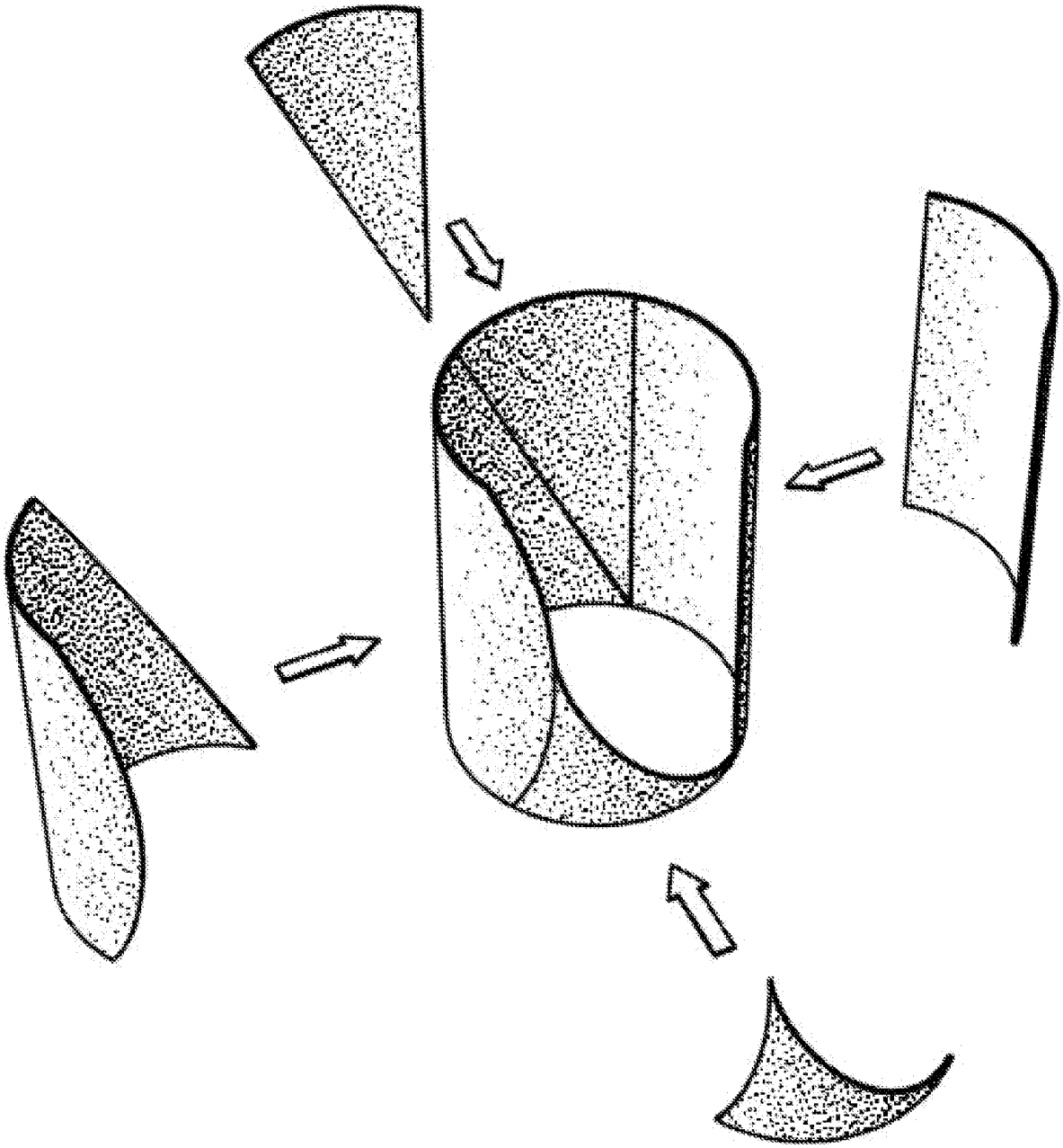
FIG. 7 shows an alternate embodiment of a stiffener as applied to a fabric tube.

FIG. 7 shows an alternate embodiment of embedding stiffened fabric materials into the fabric tube. As shown, the stiffened fabric can be any shape as needed to reinforce the fabric tube.

While the present invention is most widely applicable to undergarments such as boxer shorts or boxer briefs, it is also applicable to other types of garments. For example, an undershirt comprising long sleeves may be vulnerable to bunching for the same reason as undershorts may be. The present invention is applicable to any garment that is worn under another garment and that can bunch up under the other garment.

It is to be understood that this invention is not limited to particular aspects described, and, as such, may vary. It is also to be understood that the terminology used herein is for the purpose of describing particular aspects only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Certain ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating unrecited number may be a number which, in the context in which it is presented, provides the substantial equivalent of the specifically recited number.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual aspects described and illustrated herein has discrete components and features which may be readily separated from or combined with the features of any of the other several aspects without departing from the scope or spirit of the present invention. Any recited method can be carried out in the order of events recited or in any other order which is logically possible.

Although the foregoing invention has been described in some detail by way of illustration and example for purposes of clarity of understanding, it is readily apparent to those of ordinary skill in the art in light of the teachings of this invention that certain changes and modifications may be made thereto without departing from the spirit or scope of the appended claims.

Accordingly, the preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art and are to be construed as being without limitation to such specifically recited examples and conditions. Moreover, all statements herein reciting principles, aspects, and aspects of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary aspects shown and described herein. Rather, the scope and spirit of present invention is embodied by the appended claims.

The invention claimed is:

1. A garment intended to be worn under a second garment, comprising:

at least one fabric tube, wherein each of the at least one fabric tube comprises a vertical direction parallel to the axis of the at least one fabric tube and a horizontal direction perpendicular to the axis of the at least one fabric tube, wherein the at least one fabric tube is intended to be worn on a body of a user;

wherein the at least one fabric tube is configured to fit loosely around the body of the user and does not provide a compressional force on the body of the user;

wherein each of the at least one fabric tube comprises at least one stiffener permanently attached to the at least one fabric tube at a first location along the length of the at least one stiffener and not attached to the at least one fabric tube at a second location along the length of the at least one stiffener, wherein the at least one stiffener is placed in such a way as to prevent the at least one fabric tube from bunching in a vertical direction while the garment is worn on a body and while the second garment is put on the body over the at least one fabric tube.

2. The garment of claim 1, wherein the at least one stiffener comprises:

at least one stiffener attached to the at least one fabric tube in a vertical direction.

3. The garment of claim 1, wherein the at least one stiffener comprises:

at least one stiffener attached to the at least one fabric tube in a spiral direction.

4. The garment of claim 1, wherein the at least one stiffener comprises:

at least one stiffener shaped like a ring, wherein the ring is attached to the fabric tube.

5. The garment of claim 1, wherein the at least one stiffener comprises a polymer material.

6. The garment of claim 1, wherein the at least one stiffener comprises a plurality of sewn stitches in the at least one fabric tube.

7. The garment of claim 1, wherein the at least one stiffener comprises a thickness, wherein the thickness is measured from the axis of the at least one fabric tube in the direction perpendicular to the axis of the at least one fabric tube, wherein the thickness is 0.4-2.75 mm.

8. The garment of claim 1, wherein the at least one stiffener has a circular cross-section.

9. The garment of claim 1, wherein the at least one stiffener is a sheet element.

10. The garment of claim 9, wherein the sheet element is incorporated into the fabric tube construction.

11. The garment of claim 9, wherein the sheet element comprises a stiffened fabric.

12. The garment of claim 1, wherein at least one portion of the at least one stiffener is permanently attached to an outside of the fabric tube.

13. The garment of claim 1, wherein at least one portion of the at least one stiffener is permanently attached to an inside of the fabric tube.

14. The garment of claim 1, further comprising at least one fabric tab, wherein the at least one fabric tab is attached over an end of the at least one stiffener.

15. The garment of claim 1, wherein the garment is a pair of undershorts comprising a first leg and a second leg, wherein each one of the first leg and second leg defines one of the at least one fabric tubes, wherein each one of the first leg and second leg comprises the at least one stiffener.

16. The garment of claim 15, further comprising a waistband, wherein the at least one stiffener is permanently connected to the waistband.

17. The garment of claim 15, further comprising at least one leg band at an end of at least one of the first leg and the second leg opposite the waistband, wherein the at least one stiffener is permanently connected to the at least one leg band.

18. The garment of claim 15, wherein each one of the first leg and second leg comprises an inner leg portion, wherein the garment comprises a crotch portion, wherein at least one stiffener located in the inner leg portion does not extend into the crotch portion.

19. A garment intended to be worn under a second garment, comprising:

at least one fabric tube, wherein each of the at least one fabric tube comprises a vertical direction parallel to the axis of the at least one fabric tube and a horizontal direction perpendicular to the axis of the at least one fabric tube, wherein the at least one fabric tube is intended to be worn on a body of a user;

wherein each of the at least one fabric tube comprises at least one stiffener permanently attached to the at least one fabric tube, wherein the at least one stiffener is placed in such a way as to prevent the at least one fabric tube from bunching in a vertical direction while the garment is worn on a body and while the second garment is put on the body over the at least one fabric tube, wherein the at least one stiffener comprises:

at least one stiffener comprising a first end, a second end, and a middle portion, wherein the first end and the second end are attached to a first end of the at least one fabric tube and the middle portion is attached to a second end of the at least one fabric tube.

20. A garment intended to be worn under a second garment, comprising:

at least one fabric tube, wherein each of the at least one fabric tube comprises a vertical direction parallel to the axis of the at least one fabric tube and a horizontal direction perpendicular to the axis of the at least one fabric tube, wherein the at least one fabric tube is intended to be worn on a body of a user;

wherein each of the at least one fabric tube comprises at least one stiffener permanently attached to the at least one fabric tube, wherein the at least one stiffener is placed in such a way as to prevent the at least one fabric tube from bunching in a vertical direction while the garment is worn on a body and while the second garment is put on the body over the at least one fabric tube, wherein the garment is a pair of undershorts comprising a first leg and a second leg, wherein each one of the first leg and second leg defines one of the at least one fabric tubes, wherein each one of the first leg and second leg comprises the at least one stiffener, further comprising a crotch portion, wherein the at least one stiffener comprises a first end connected to an end of at least one of the first leg and the second leg, a middle portion that is connected to a boundary between the crotch portion and the at least one of the first leg and the second leg and is shaped in such a way as to duplicate a shape of the boundary, and a second end connected to the end of the at least one of the first leg and second leg.

21. A garment intended to be worn under a second garment, comprising:

at least one fabric tube, wherein each of the at least one fabric tube comprises a vertical direction parallel to the axis of the at least one fabric tube and a horizontal direction perpendicular to the axis of the at least one fabric tube, wherein the at least one fabric tube is intended to be worn on a body of a user;

wherein each of the at least one fabric tube comprises at least one stiffener permanently attached to the at least one fabric tube, wherein the at least one stiffener is placed in such a way as to prevent the at least one fabric tube from bunching in a vertical direction while the garment is worn on a body and while the second garment is put on the body over the at least one fabric tube, wherein the garment is a pair of undershorts comprising a first leg and a second leg, wherein each one of the first leg and second leg defines one of the at least one fabric tubes, wherein each one of the first leg and second leg comprises the at least one stiffener, wherein the at least one stiffener comprises a first end connected to the waistband, a second end connected to the waistband, and a middle portion that is connected to the end of at least one of the first leg and second leg.

* * * * *